US012421980B1

(12) United States Patent
Deng et al.

(10) Patent No.: US 12,421,980 B1
(45) Date of Patent: Sep. 23, 2025

(54) COMPACT CONTINUOUS HIGH-SPEED BLOW DRYER

(71) Applicant: KERUI TECHNOLOGY (DONGGUAN) CO., LTD, Dongguan (CN)

(72) Inventors: Min Deng, Dongguan (CN); Hongmin Wei, Dongguan (CN); Mu Yan, Dongguan (CN)

(73) Assignee: KERUI TECHNOLOGY (DONGGUAN) CO., LTD, Dongguan (CN)

( * ) Notice: Subject to any disclaimer, the term of this patent is extended or adjusted under 35 U.S.C. 154(b) by 0 days.

(21) Appl. No.: 18/905,373

(22) Filed: Oct. 3, 2024

(51) Int. Cl.
*F04D 29/54* (2006.01)
*F04D 19/00* (2006.01)
*F04D 29/52* (2006.01)

(52) U.S. Cl.
CPC ..... *F04D 29/545* (2013.01); *F04D 19/002* (2013.01); *F04D 29/522* (2013.01)

(58) Field of Classification Search
CPC ..... F04D 29/545; F04D 19/002; F04D 29/522
See application file for complete search history.

(56) References Cited

U.S. PATENT DOCUMENTS 4,610,601 A * 9/1986 Gerfast ..... F03D 1/04 29/889.3
5,279,379 A * 1/1994 Sixsmith ..... B60V 1/14 180/117
11,946,392 B1 * 4/2024 Slipper ..... F04D 29/545
2017/0335852 A1 * 11/2017 Myers McCarthy ..... F04D 29/665
2019/0178252 A1 * 6/2019 Dygert ..... F24F 1/029
2020/0141418 A1 * 5/2020 Aiello ..... F04D 19/002
2023/0098664 A1 * 3/2023 Conrad ..... A45D 20/00 417/423.1
2023/0204038 A1 * 6/2023 Rezaei ..... F04D 29/164 415/182.1
2023/0279866 A1 * 9/2023 Jennings ..... F04D 29/281 416/204 R
2024/0360842 A1 * 10/2024 Rezaei ..... F04D 29/542
2024/0410387 A1 * 12/2024 Loercher ..... F04D 29/646

* cited by examiner

*Primary Examiner* — Aaron R Eastman
(74) *Attorney, Agent, or Firm* — FIDELI LAW PLLC; Qiang Li

(57) ABSTRACT

The disclosure relates to the technical field of blow dryers, and in particular to a compact continuous high-speed blow dryer. By improving optimized design of an air duct, while a wind resistance coefficient of guide vanes is reduced, values of flow rates in paths can be ensured, so that a fluid can be led out of the air duct linearly and uniformly and a fan blade can operate stably. Auxiliary support structures such as a spring, bearings and an air guide pad further stabilize a position of the fan blade and avoid centrifugal vibration of the fan blade, which eventually reacts on a rotating shaft and affects rotational efficiency of the rotating shaft. Therefore, an operating environment of the fan blade is greatly improved, and overall efficiency of the fan is improved, Moreover, since the operating environment of the fan blade is optimized, stability of the fan is enhanced, and further, service life of the fan is prolonged.

6 Claims, 5 Drawing Sheets

COMPACT CONTINUOUS HIGH-SPEED BLOW DRYER

BACKGROUND

1. Technical Field

The disclosure relates to the technical field of blow dryers, and in particular to a compact continuous high-speed blow dryer.

2. Background Information

Nowadays, brushless motors are becoming smaller, lighter and faster. However, there are few high-efficiency axial flow fans matched with high rotational speed, especially those with a diameter of less than 100 mm. The development of small and medium-sized axial flow fans and high-speed DC brushless motors has only gradually begun after the introduction of products such as high-speed blow dryer motors, bladeless fans and curling irons.

The smaller the size of a home appliance, the higher the requirements for shock absorption and noise reduction details of the motor in its application scenarios. Most of the improvements on the market today are made by improving the structural size of the brushless motor itself and adapting it to the applicable scenarios of the home appliance, while ignoring the design impact of the combined air guide structure. When the impeller rotates, air enters the impeller axially from the air inlet. When the air is pushed by the vanes on the impeller, the energy of the air rises. Then, the air flows into the guide vanes and is guided by the guide vanes to the outside. However, since the impeller rotates at a high speed, the combination of the design of the angle of the vanes with the design of the guide vanes can easily lead to intermittent gushing of air flowing out of the guide vanes, which makes the inflow air of the axial guide vanes less smooth. At the same time, the gushing air reacts on the impeller, causing the impeller to vibrate, which thus has become one of the difficult technical problems to overcome.

BRIEF SUMMARY

In view of the above defects in the prior art, an objective of the disclosure is to provide a compact continuous high-speed blow dryer, which has the advantages of linear and smooth airflow, high stability and long service life.

The above technical objective of the disclosure is achieved by the following technical solution: A compact continuous high-speed blow dryer includes a stator assembly, a rotor assembly rotating on the stator assembly, an air duct sleeved on the stator assembly and a fan blade mounted on the stator assembly. The air duct includes an outer duct and an inner duct arranged with a same center axis as the outer duct, and the inner duct is sleeved on the rotor assembly and fixed to the stator assembly.

The outer duct is distributed with an air inlet portion and an air outlet portion along a length direction of the outer duct, an air guide pad is laid on an inner wall of the air inlet portion, the air guide pad extends along an axis direction of the air duct, the air inlet portion near the air outlet portion is inclined outward to form a flare, a diameter of the fan blade is slightly smaller than a diameter of the air guide pad, the air outlet portion extends outward in a straight line, a plurality of uniformly distributed guide vanes are connected and fixed between the air outlet portion and the outer duct, the guide vanes are each arranged in the shape of a circular arc airfoil, a distance between the adjacent guide vanes is always consistent, curved connected paths are formed between an inner wall of the outer duct, an outer wall of the inner duct and the adjacent guide vanes, and the adjacent paths have a same volume.

A side of the inner duct near the fan blade is provided with an air inlet bevel, and an inclination angle of the air inlet bevel is the same as an inclination angle of the air guide pad.

Preferably, the rotor assembly includes a rotating shaft, the rotating shaft is provided with a swivel bearing, a first balance weight, a second balance weight and an auxiliary bearing along a length direction of the rotating shaft, the first balance weight and the second balance weight are respectively arranged at two ends of the rotating shaft and serve as stable supports, the auxiliary bearing is connected with the stator assembly, the fan blade is mounted on the swivel bearing, a spring is connected between the swivel bearing and the first balance weight, and the spring is sleeved on the rotating shaft.

Preferably, the fan blade includes an impeller mounted on the swivel bearing and vanes uniformly distributed along a circumferential direction of the impeller, and a ratio of a diameter of the impeller to a length of the vane is set to 29:11.

Preferably, an inclination angle of the vanes is the same as an inclination angle of the guide vanes, and air is allowed to form continuous and stable natural wind, which greatly reduces the beating sensation caused by wind directly blown from the fan blade.

Preferably, the air guide pad is a stainless steel product mounted against an inner wall of the outer duct to limit a mounting space of the fan blade in the air duct.

Preferably, the inclination angle at which the vanes are mounted is in the range of 20° to 30°.

Based on the above, the disclosure has the following beneficial effects: By improving the optimized design of the air duct, while the wind resistance coefficient of the guide vanes is reduced, values of the flow rates in the paths can be ensured, so that the fluid can be led out of the air duct linearly and uniformly and the fan blade can operate stably. The auxiliary support structures such as the spring, the bearings and the air guide pad further stabilize the position of the fan blade and avoid centrifugal vibration of the fan blade, which eventually reacts on the rotating shaft and affects the rotational efficiency of the rotating shaft. Therefore, an operating environment of the fan blade is greatly improved, and overall efficiency of the fan is improved, Moreover, since the operating environment of the fan blade is optimized, stability of the fan is enhanced, and further, service life of the fan is prolonged.

REFERENCE SIGNS

1, stator assembly; 2, rotor assembly; 21, rotating shaft; 22, swivel bearing; 23, first balance weight; 24, second balance weight; 25, auxiliary bearing; 26, spring; 3, air duct; 31, outer duct; 32, inner duct; 33, air inlet portion; 34, air outlet portion; 35, air guide pad; 36, guide vane; 37, path; 38, air inlet bevel; 4, fan blade; 41, impeller; 42, vane.

DETAILED DESCRIPTION OF THE DRAWINGS AND THE PRESENTLY PREFERRED EMBODIMENTS

In order to make the technical problems to be solved, technical solutions and advantageous effects of the disclosure clear, the disclosure will be described in detail below with reference to the accompanying drawing and examples. It should be understood that the specific examples described herein are merely illustrative of the disclosure and are not intended to limit the disclosure.

It should be noted that when a component is referred to as being "fixed to" or "arranged on" another component, it may be directly or indirectly on the another component. When a component is referred to as being "connected to" another component, it may be directly or indirectly connected to the another component.

It should be understood that the terms "length", "width", "upper", "lower", "front", "rear", "left", "right", "vertical", "horizontal", "top", "bottom", "inside", "outside", etc. indicate an orientation or positional relationship based on the orientation or positional relationship shown in the accompanying drawings. This is only for the convenience of describing the disclosure and simplifying the description, and does not indicate or imply that the device or element must have a specific orientation, or be constructed and operated in a specific orientation. Therefore, these terms are not to be construed as limiting the disclosure.

In addition, the terms "first" and "second" are merely used for descriptive purposes, and cannot be understood as indicating or implying relative importance or implicitly indicating the number of technical features indicated. Thus, the features defined with "first" and "second" may explicitly or implicitly include one or more of the features. In the description of the disclosure, "a plurality of" means two or more than two, unless otherwise specifically defined.

Since the structure of an axial flow fan is directly related to the aerodynamic performance of the fan, which includes the joint influence of a variety of factors such as the distribution of design parameters between vanes, the interference between stator and rotor blades, axial and radial clearances and various vortex structures. Based on the above theory, this example provides a compact continuous high-speed blow dryer.

Figure 1:
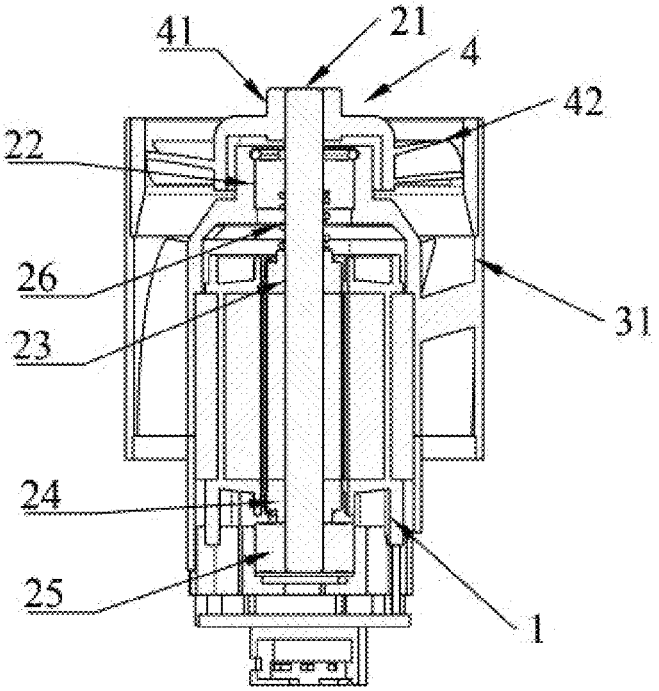
FIG. 1 is a schematic internal structural view of an example of the disclosure.
Figure 2:
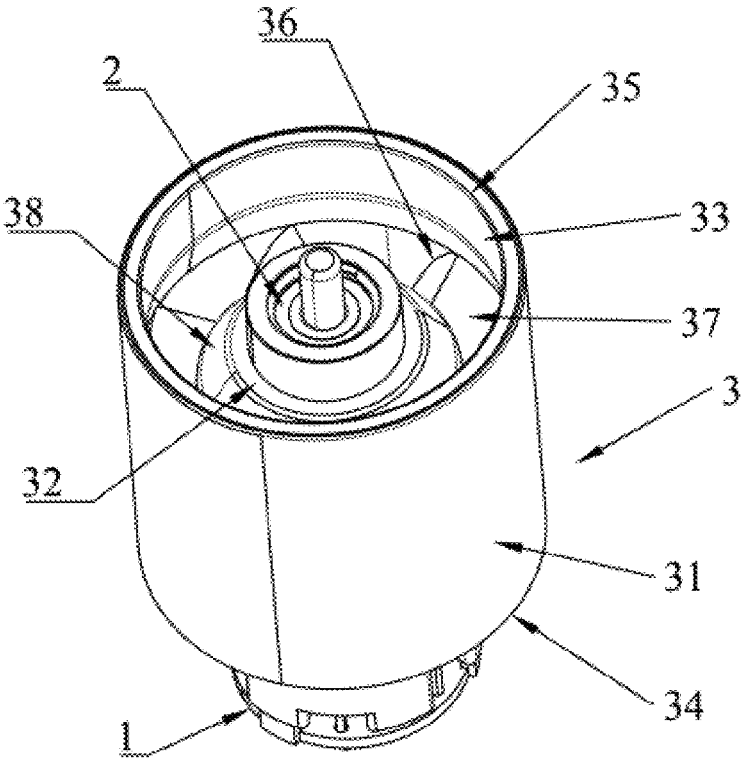
FIG. 2 is a sectional view of an example of the disclosure.
Figure 3:
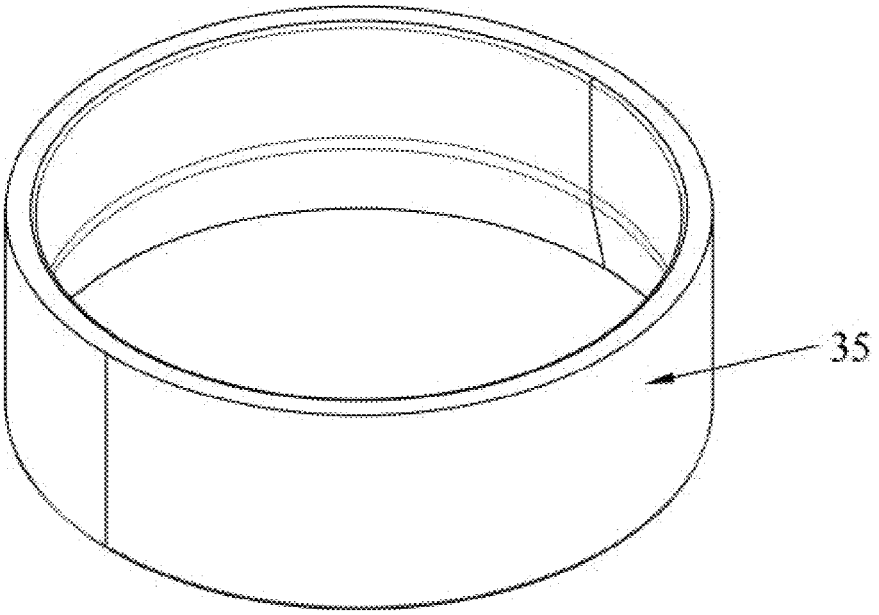
FIG. 3 is a schematic structural view of an air guide pad according to an example of the disclosure.

A compact continuous high-speed blow dryer is shown in FIG. 1. A stator assembly 1 is fixed. While a rotor assembly 2 is used to drive a fan blade 4 to rotate at a high speed, by optimizing the structural design of an air guide duct 3, i.e., an air duct 3, a fluid is driven by the fan blade 4 to flow into the air duct 3, so that a high pressure is generated in a semiclosed space formed by an outer duct 31 and an inner duct 32 arranged with a same center axis as the outer duct 31. The fluid enters from an air inlet portion 33 of the outer duct 31, and is guided by an air outlet portion 34 to flow into the semiclosed space. An air guide pad 35 is laid on an inner wall of the air inlet portion 33. An air inlet diameter of the outer duct 31 can be reduced by the air guide pad 35, and a design ratio of a diameter of an impeller 41 to a length of a vane 42 in the fan blade 4 is also adjusted, which can maximize the flow rate of the fluid. Moreover, with the outer duct 31 having a smaller air inlet diameter, the fluid entering the air inlet portion 33 can obtain a higher pressure, thereby providing greater power for the subsequent flow of the fluid.

Figure 4:
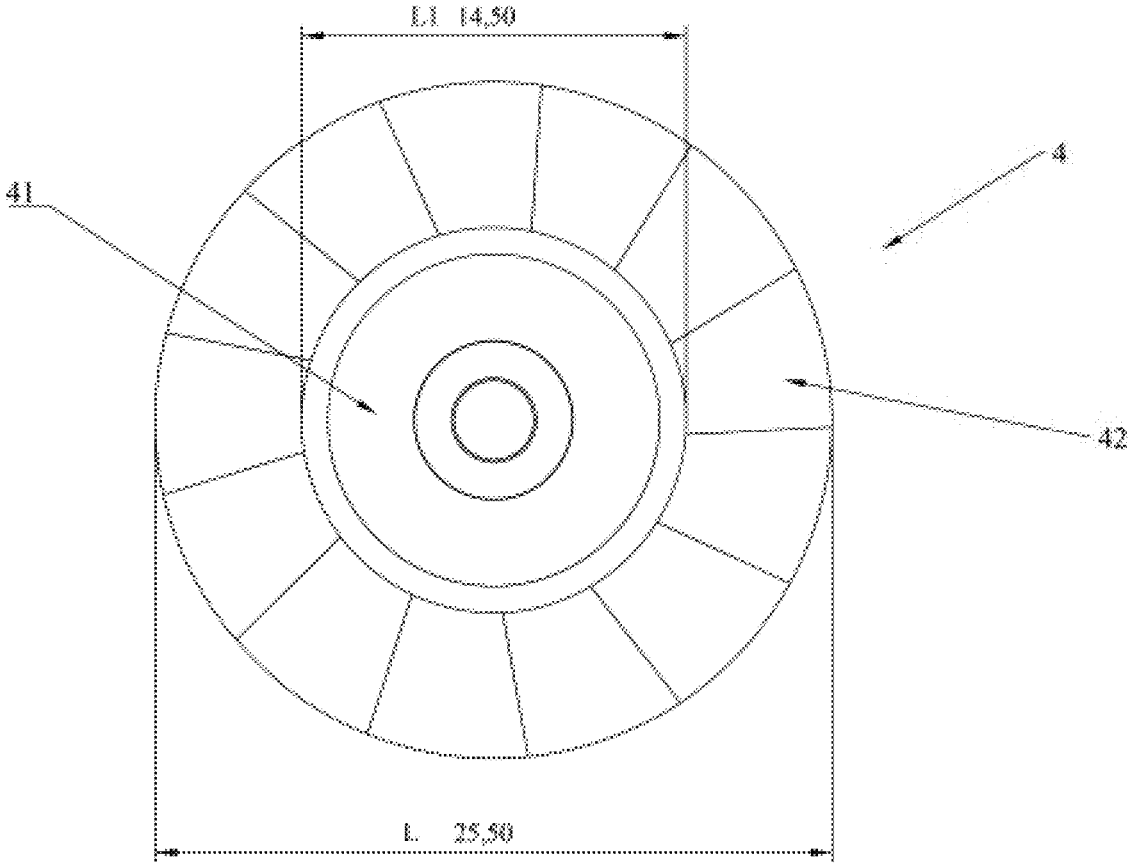
FIG. 4 is a schematic structural front view of a fan blade according to an example of the disclosure.
Figure 5:
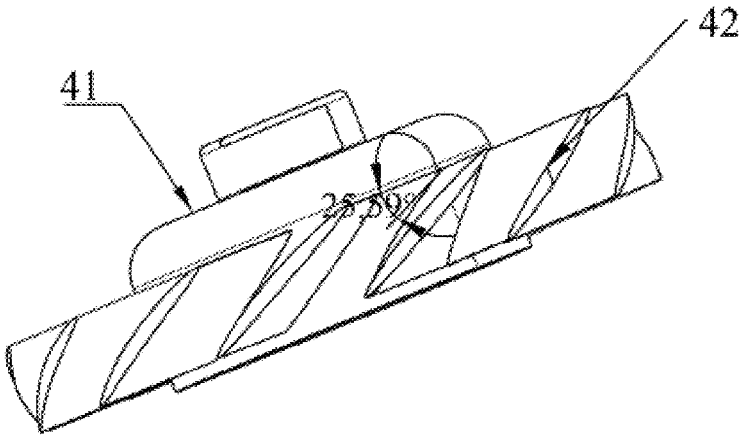
FIG. 5 is a schematic structural side view of the fan blade according to an example of the disclosure.

Referring to FIG. 4 and FIG. 5, the length of the vane 42 at the same rotational speed directly affects the change in the flow rate of the fluid, but the diameter of the impeller 41 directly affects the stability of the vanes 42, so they should cooperate and work together. The design ratio of the diameter of the impeller 41 to the length of the vane 42 directly affects the change in the fluid driven by the fan blade 4. Under the condition that the diameter of the outer duct 31 is fixed, experiments have been designed at the same rotational speed, and it is found that the most suitable ratio of the diameter of the impeller 41 (in cm) to the length of the vane 42 (in cm) is designed as 29:11.

When the fluid enters the air outlet portion 34, it is necessary to appropriately reduce the flow velocity of the fluid and ensure the fluid at the air outlet portion 34 to be uniform and slow, i.e., ensure the subsequent air to flow linearly, uniformly and smoothly and to directly act on the human body for blowing operation.

The fluid with great power flows out of the air outlet portion 34. The air inlet portion 33 near the air outlet portion 34 is inclined outward to form a flare, and the inner duct 32 is mounted on the stator assembly 1, which provides a guide space for the fast flow of the fluid. Moreover, a plurality of uniformly distributed guide vanes 36 are connected and fixed between the air outlet portion 34 and the outer duct 31, so that the guide space between the inner duct 32 and the outer duct 31 is equally divided. In addition, the guide vanes 36 are each arranged in the shape of a circular arc airfoil, so that curved connected paths 37 for fluid flowing are formed between an inner wall of the outer duct 31, an outer wall of the inner duct 32 and peripheries of the adjacent guide vanes 36.

When the rotating shaft 21 rotates, the acting direction of the centrifugal force always points to the center of the rotating shaft 21, and the axial component of the rotating shaft 21 acts on the axis direction of the rotating shaft 21 in turn, so that the rotating shaft 21 undergoes bending deformation, i.e., deflection. In addition, the swivel bearing 22 and the fan blade 4 mounted at the end of the rotating shaft 21 make the deformation of the rotating shaft 21 more severe, which causes the fan blade 4 to swing left and right. Under the condition that the inner diameter of the outer duct 31 is fixed, the air guide pad 35 further limits the moving space of the fan blade 4, thereby reducing the deflection and improving the efficiency. Moreover, the rotating shaft 21 is a flexible shaft.

Under this condition, the rotating shaft 21 is provided with the swivel bearing 22, a first balance weight 23, a second balance weight 24 and an auxiliary bearing 25 along a length direction of the rotating shaft; the rotating shaft 21 and the stator assembly 1 are connected and mounted through the auxiliary bearing 25 and the second balance weight 24; one end of the rotating shaft 21 is auxiliarily supported by both the auxiliary bearing 25 and the second balance weight 24, and the other end is auxiliarily supported by the first balance weight 23; and the first balance weight 23, the second balance weight 24 and the auxiliary bearing 25 support most of the rotating shaft 21 in length, thereby improving the stability of the rotating shaft 21. Moreover, the fan blade 4 is mounted by means of the swivel bearing 22, and a spring 26 is sleeved on the rotating shaft 21, so that a distance between the swivel bearing 22 and the first balance weight 23 is always constant through elastic compression of the spring 26.

The surrounding of the outer duct 31 and the compression of the inner duct 32 together with the guide vanes 36 in the shape of a circular arc airfoil can effectively reduce the flow loss. Based on the fact that the number of vanes 42 of the fan blade 4 is 13, mounting angles of the vanes 42 are sequentially adjusted to 20° to 30°. Through the testing at 0.5° intervals, the flow rate in the air duct 3 at different angles is measured.

| No. | Flow rate ($m^3/s$) | Angle (X°) | Power (W) | Rotational speed (rpm) |
|---|---|---|---|---|
| 1 | 0.172 | 20 | 90.90 | 110214.84 |
| 2 | 0.176 | 20.5 | 99.95 | 110449.22 |
| 3 | 0.180 | 21 | 93.27 | 110156.25 |
| 4 | 0.184 | 21.5 | 102.60 | 110214.84 |
| 5 | 0.194 | 22 | 98.63 | 110097.66 |
| 6 | 0.187 | 22.5 | 102.01 | 110507.81 |
| 7 | 0.193 | 23 | 90.99 | 110332.03 |
| 8 | 0.196 | 23.5 | 95.49 | 110214.84 |
| 9 | 0.203 | 24 | 93.71 | 110390.62 |
| 10 | 0.210 | 24.5 | 93.88 | 110390.62 |
| 11 | 0.223 | 25 | 97.47 | 110449.22 |
| 12 | 0.228 | 25.5 | 96.11 | 110214.84 |
| 13 | 0.245 | 26 | 90.68 | 110156.25 |
| 14 | 0.239 | 26.5 | 90.29 | 110800.78 |
| 15 | 0.243 | 27 | 96.14 | 110097.66 |
| 16 | 0.246 | 27.5 | 96.82 | 110449.22 |
| 17 | 0.250 | 28 | 94.61 | 110039.06 |
| 18 | 0.251 | 28.5 | 103.53 | 110449.22 |
| 19 | 0.248 | 29 | 96.74 | 110156.25 |
| 20 | 0.263 | 29.5 | 96.01 | 110273.44 |
| 21 | 0.253 | 30 | 95.32 | 110566.41 |

Thereby, in order to ensure a high flow rate in the air duct 3, the inclination angle at which the vanes 42 are mounted is in the range of 20° to 30°, preferably 29.5°.

After the inclination angle at which the vanes 42 are mounted is determined, in order to reduce the wind resistance coefficient in the air duct 3, an inclination angle of the guide vanes 36 is kept consistent with the inclination angle at which the vanes 42 are mounted. Based on this, the power, wind speed, rotational speed and noise are tested:

| No. | Power (W) | Wind speed (m/s) | Rotational speed (rpm) | Noise (dB) |
|---|---|---|---|---|
| 1 | 97.95 | 46.85 | 110390.62 | 78.18 |
| 2 | 99.84 | 45.08 | 110214.84 | 78.56 |
| 3 | 100.93 | 45.71 | 110449.22 | 78.74 |
| 4 | 93.48 | 44.25 | 110390.62 | 78.32 |
| 5 | 92.71 | 47.99 | 110390.62 | 78.42 |
| 6 | 90.67 | 46.07 | 110332.03 | 76.81 |
| 7 | 91.67 | 46.12 | 110507.81 | 76.74 |
| 8 | 90.36 | 45.55 | 110332.03 | 76.67 |
| 9 | 89.36 | 45.40 | 110332.03 | 76.80 |
| 10 | 93.86 | 47.94 | 110507.81 | 77.85 |
| 11 | 88.30 | 44.88 | 110683.59 | 77.09 |
| 12 | 93.14 | 46.59 | 110273.44 | 70.25 |
| 13 | 89.19 | 45.55 | 110566.41 | 69.35 |
| 14 | 91.40 | 45.81 | 110507.81 | 76.34 |
| 15 | 90.09 | 46.12 | 110449.22 | 76.77 |
| 16 | 101.28 | 43.89 | 110332.03 | 77.20 |
| 17 | 99.08 | 46.59 | 110332.03 | 78.63 |
| 18 | 97.67 | 45.81 | 110566.41 | 79.21 |
| 19 | 94.38 | 45.97 | 110449.22 | 78.74 |
| 20 | 96.23 | 47.19 | 110156.25 | 79.45 |
| 21 | 91.96 | 45.86 | 110273.44 | 77.31 |

Note: The wind speed is the maximum wind speed directly measured by an anemometer at the air outlet portion.

By improving the optimized design of the air duct 3, while the wind resistance coefficient of the guide vanes 36 is reduced, values of the flow rates in the paths 37 can be ensured, so that the fluid can be led out of the air duct 3 linearly and uniformly and the fan blade 4 can operate stably. The auxiliary support structures such as the spring 26, the bearings and the air guide pad 35 further stabilize the position of the fan blade 4 and avoid centrifugal vibration of the fan blade 4, which eventually reacts on the rotating shaft 21 and affects the rotational efficiency of the rotating shaft 21. Therefore, an operating environment of the fan blade 4 is greatly improved, and overall efficiency of the fan is improved, Moreover, since the operating environment of the fan blade 4 is optimized, stability of the fan is enhanced, and further, service life of the fan is prolonged.

The above examples are only an explanation of the disclosure, and are not intended to limit the disclosure. Those skilled in the art can make modifications without any creative contribution to the present example as needed after reading this specification. However, it is protected by patent law as long as it is within the scope of the claims of the disclosure.

The invention claimed is:

1. A high-speed blow dryer, comprising:

a stator assembly;

a rotor assembly rotating on the stator assembly;

an air duct sleeved on the stator assembly and a fan blade mounted on the stator assembly; wherein the air duct comprises an outer duct and an inner duct arranged with a same center axis as the outer duct, and the inner duct is sleeved on the rotor assembly and fixed to the stator assembly;

the outer duct is distributed with an air inlet portion and an air outlet portion along a length direction of the outer duct, an air guide pad is laid on an inner wall of the air inlet portion, the air guide pad extends along an axis direction of the air duct, the air inlet portion near the air outlet portion is inclined outward to form a flare, a diameter of the fan blade is slightly smaller than a diameter of the air guide pad, the air outlet portion extends outward in a straight line, a plurality of uniformly distributed guide vanes are connected and fixed between the air outlet portion and the outer duct, the guide vanes are each arranged in the shape of a circular arc airfoil, a distance between the adjacent guide vanes is always consistent, curved connected paths are formed between an inner wall of the outer duct, an outer wall of the inner duct and the adjacent guide vanes, and the adjacent paths have a same volume; and a side of the inner duct near the fan blade is provided with an air inlet bevel, and an inclination angle of the air inlet bevel is the same as an inclination angle of the air guide pad.

2. The high-speed blow dryer according to claim 1, wherein the rotor assembly comprises a rotating shaft, the rotating shaft is provided with a swivel bearing, a first balance weight, a second balance weight and an auxiliary bearing along a length direction of the rotating shaft, the first balance weight and the second balance weight are respectively arranged at two ends of the rotating shaft and serve as stable supports, the auxiliary bearing is connected with the stator assembly, the fan blade is mounted on the swivel bearing, a spring is connected between the swivel bearing and the first balance weight, and the spring is sleeved on the rotating shaft.

3. The high-speed blow dryer according to claim 2, wherein the fan blade comprises an impeller mounted on the swivel bearing and vanes uniformly distributed along a circumferential direction of the impeller, and a ratio of a diameter of the impeller to a length of the vane is set to 29:11.

4. The high-speed blow dryer according to claim 3, wherein an inclination angle of the vanes is the same as an inclination angle of the guide vanes.

5. The high-speed blow dryer according to claim 4, wherein the inclination angle at which the vanes are mounted is in the range of 20° to 30°.

6. The high-speed blow dryer according to claim 1, wherein the air guide pad is a stainless steel product mounted against an inner wall of the outer duct to limit a mounting space of the fan blade in the air duct.

* * * * *